United States Patent [19]

Brunton

[11] Patent Number: 4,691,615

[45] Date of Patent: Sep. 8, 1987

[54] M-16 RIFLE, IMPROVED TO MORE SAFELY ACCOMODATE LEFT HANDED SHOOTERS

[76] Inventor: Loren F. Brunton, 363 - 34th Ave., East Moline, Ill. 61244

[21] Appl. No.: 845,672

[22] Filed: Mar. 27, 1986

Related U.S. Application Data

[63] Continuation-in-part of Ser. No. 505,621, Jun. 20, 1983, Pat. No. Des. 285,236.

[51] Int. Cl.[4] ..... F41C 27/00

[52] U.S. Cl. ..... 89/33.4

[58] Field of Search ..... D22/108; 42/16, 98; 89/33.4

[56] References Cited

U.S. PATENT DOCUMENTS

| | | | |
|---|---|---|---|
| 804,661 | 11/1905 | Johnson | 42/98 |
| 946,210 | 1/1910 | Febiger | 42/98 |
| 968,139 | 8/1910 | Febiger | 42/98 |
| 1,346,329 | 7/1920 | Mehta | 42/98 |
| 4,334,375 | 6/1982 | Olsen | 42/98 |

*Primary Examiner*—Stephen C. Bentley

*Attorney, Agent, or Firm*—Anthony T. Lane; Harold H. Card, Jr.; Michael C. Sachs

[57] ABSTRACT

Disclosed is a new rifle receiver body for an M-16 rifle, incorporating a deflector portion adapted to divert spent cartridge cases away from the person of the user, away from the face and neck of a left-handed shooter for example. While particularly useful for the protection of a left-handed shooter, it in no way affects the use of the gun and can be used for right-handed users in the usual way. The deflector is a boss located at the rear of the ejection port, jutting out from the right side of the rifle body.

4 Claims, 7 Drawing Figures

M-16 RIFLE, IMPROVED TO MORE SAFELY ACCOMODATE LEFT HANDED SHOOTERS

GOVERNMENTAL INTEREST

The invention described herein may be made, used or licensed by the Government for governmental purposes without the payment to me of any royalty thereon or therefor.

This application is a continuation-in-part of application Ser. No. 505,621, filed June 20, 1983, now U.S. Pat. No. Des. 285,236.

BACKGROUND AND FIELD OF THE INVENTION

This invention relates to the field of firearms, and in particular to the U.S. Army's standard M-16 series rifle, including but not limited to the M16, M16A1, M16A2, M16A2E1, XM4 Carbine, M231 Firing Port weapon, XM177 Submachinegun, and commercial variations thereof.

The conventional M16 Rifle is designed so the spent cartridge case strikes a small deflector rib at the back of what is known as the ejection port and rebounds forward at about 45°. At the rifle's cyclic rate of fire decreases, the ejection pattern slowly shifts rearward. At around 725 rounds per minute, the spent case misses the current deflector rib and spins back almost parallel to the side of the rifle, on the right side looking from the shooter's perspective. For left handed riflemen, this condition is dangerous because the hot spent cases strike them in the face and neck, sometimes causing burns. In one unfortunate incident for a left handed shooter, a burning hot case rolled inside his open shirt neck, eventually burning his stomach areas; panic shooting led to accidental death of one soldier and wounding of still others. For the right handed soldier, such spent cases would probably just go over the right shoulder where the rifle butt rests, if they missed the back end of the ejection port. For a left-hander, however, the rifle butt rests on the left shoulder; the fired cases which miss the rib would then likely hit him in the face or neck. Yet some 18–22% of soldiers statistically are estimated to be left-handed. Clearly then, any improvement to safeguard the left handed shooter against spent cases is greatly needed, especially with the M-16, given its widespread use by the Marines and Army as a standard weapon.

BRIEF DESCRIPTION OF THE INVENTION

To remedy this problem, this invention provides for a deflector which is made an integral part of the rifle positioned to the rear of the ejection port jutting out towards the right side. It provides a barrier for fired cases, preventing same from coming straight back into the shooter's face, but instead to strike and bounce off the deflector and being forced to land considerably away from the shooter's person.

OBJECTS OF THE INVENTION

It is an object of this invention to provide an improved rifle which permits use by left handed shooters without the possibility of spent cartridge cases being cast in the dirction of the shooter's face and neck areas.

Another object of this invention is to adapt an M-16 rifle particularly to the needs of the left handed shooter, without affecting its ordinary operation.

Still another object of the invention is to provide a rifle which may be used by either left or right handed operators, without the need of any field adaption for the left-hander, to avoid the possibility of his injury.

Other objects and advantages of the invention will become apparent to those skilled in the art from a reading of the attached specification and drawings, in which:

LIST OF FIGURES

DETAILED DESCRIPTION OF THE INVENTION

Applicant here assumes that the reader starts with knowledge of the ordinary spent cartridge ejection process at it pertains to the M-16, at what is termed the said ejection port.

Figure 1:
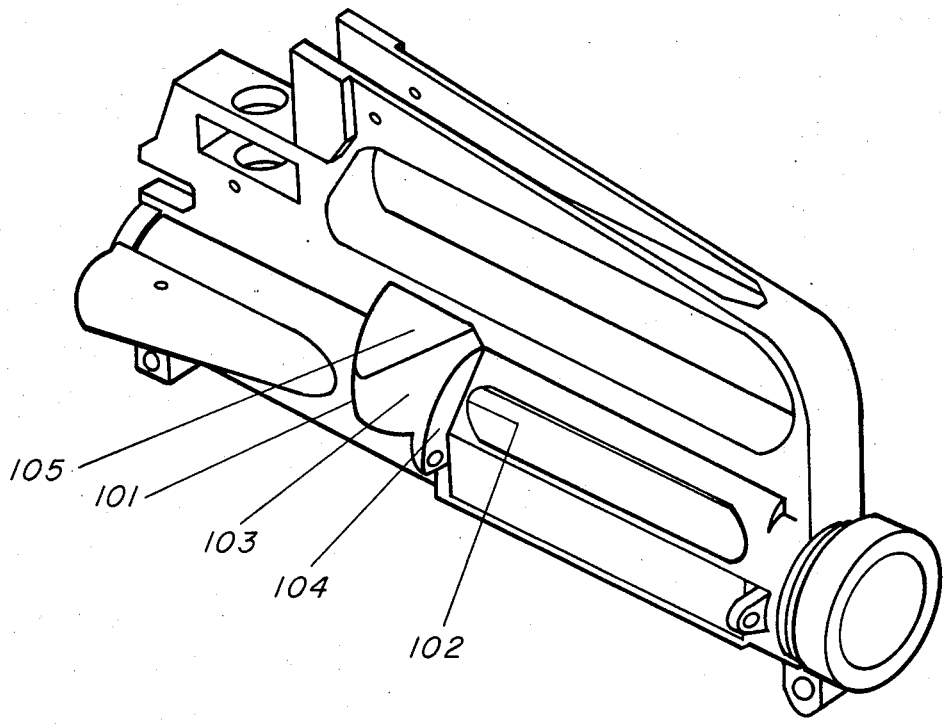
FIG. 1 shows a perspective view of the rifle receiver.
Figure 2:
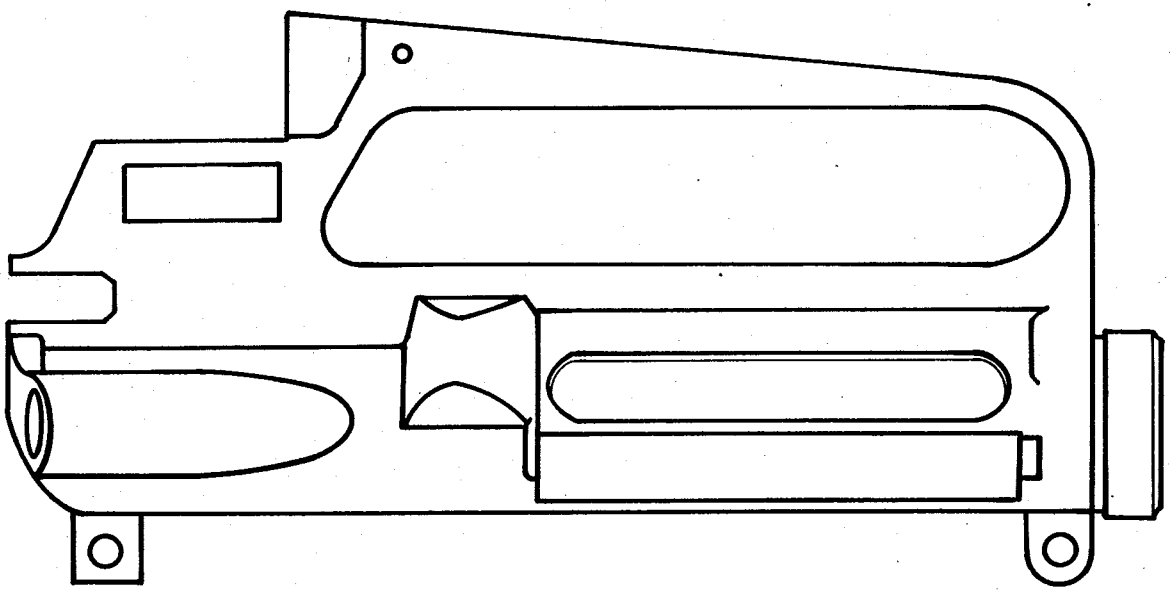
FIG. 2 shows a right side elevational view of the rifle receiver.
Figure 3:
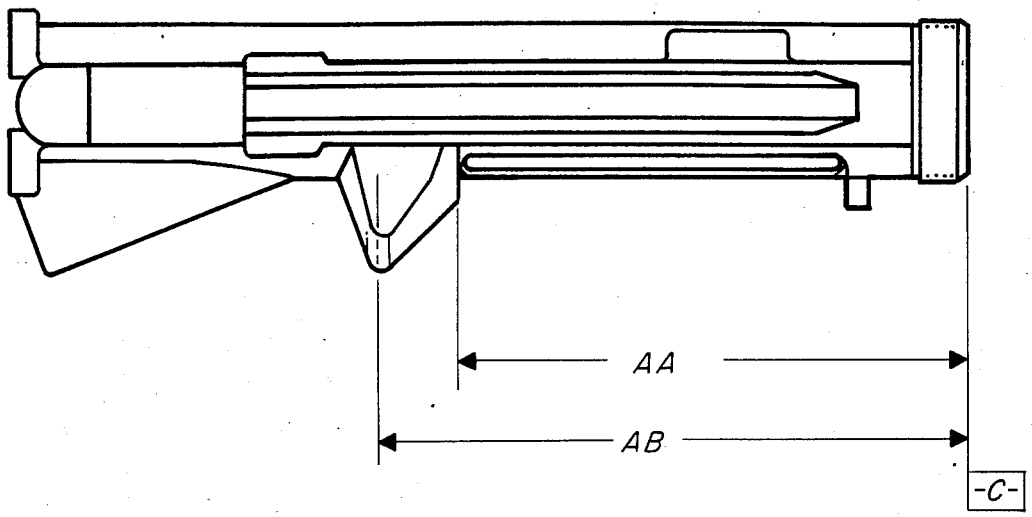
FIG. 3 shows a top plan view thereof.
Figure 4:
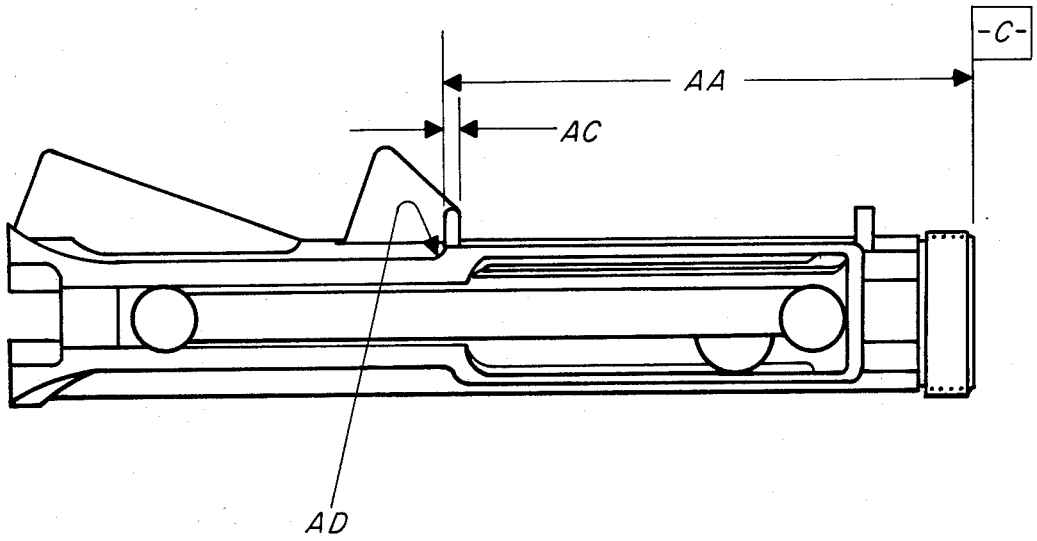
FIG. 4 shows a bottom view of the rifle receiver.
Figure 5:
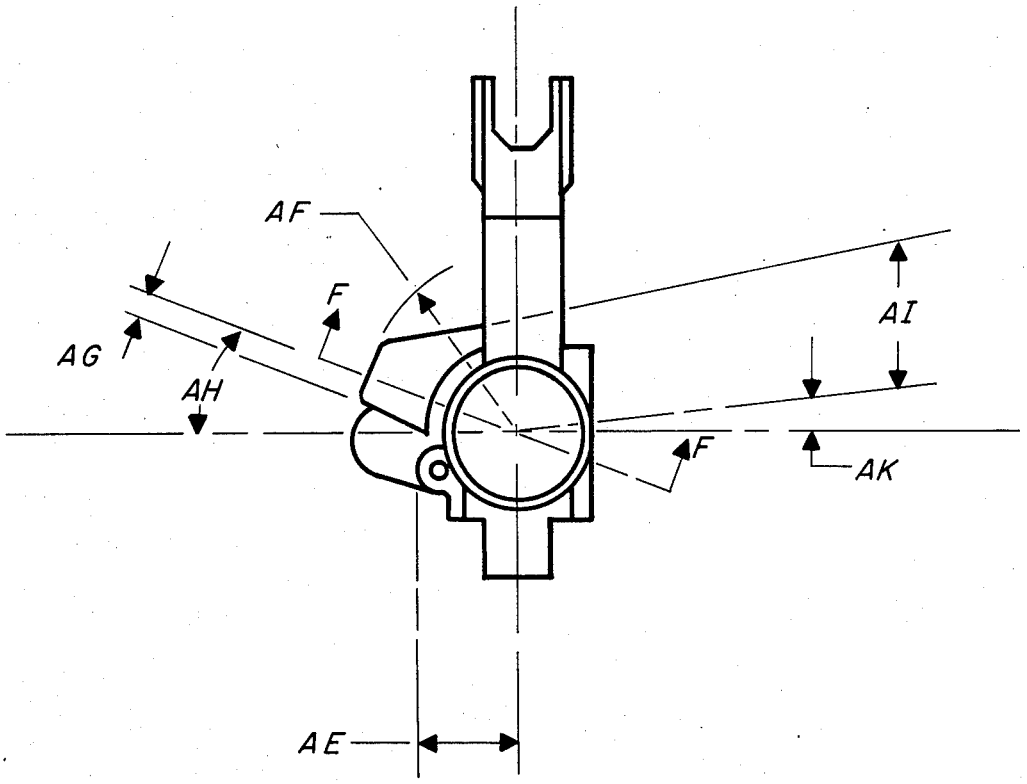
FIG. 5 shows a front elevational view thereof.
Figure 6:
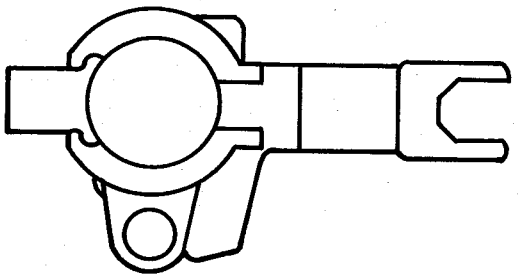
FIG. 6 shows a rear elevational view thereof.

As was mentioned previously, the conventional M-16 rifle is designed so the spent cartridge case strikes a small deflector rib at the back of the ejection port, 102 area in FIG. 1, and rebounds forward at about 45°. FIGS. 2–6 show more detail of the receiver from various views. As the rifle's cyclic rate of fire decreases, the ejection pattern slowly shifts rearward. At around 725 rounds per minute, the spent case misses the current deflector rib and spins back almost parallel to the side of the rifle, on the right side looking from the shooter's perspective. For left handed riflemen, this condition is dangerous because the hot spent cases strike them in the face and neck, sometimes causing burns. In this invention, the rifle receiver includes a boss 101, which is part of the receiver when the receiver is originally made, however it is envisioned, the invention could be added on the standard receiver as an attachment. Now looking in the shooter's perspective in the direction down the barrel, spent cartridge cases which miss the current rib at the back end of the ejection port 102 as by being a bit to the right on the rifle's receiver would encounter boss 101 as an obstacle. From surface 103, the cases would be deflected at a shallow angle to the right of the left-handed shooter. A left-handed shooter, and certainly a right-handed shooter, is protected from hot, spent cartridge cases ever striking him.

| Dimensions shown in the FIGS. are as follows: | |
|---|---|
| AA | 4.12" |
| AB | 4.75" |
| AC | 0.16" |
| AD | 0.09" R |
| AE | 0.80" |
| AF | 1.31" R |
| AG | 0.25" |
| AH | 22° 30' |
| AI | 0.87" |
| AK | 8° |
| AL | 21° |
| AM | 46° |
| AN | .09 R |
| AO | (.59 R) |
| AP | (1.31 R) |
| AQ | 1.38 R TO THEORETICAL SHARP CORNER |

-continued

| Dimensions shown in the FIGS. are as follows: | |
|---|---|
| AR | 4.756 to —C— |
| AS | 4.12 to —C— |

Figure 7:
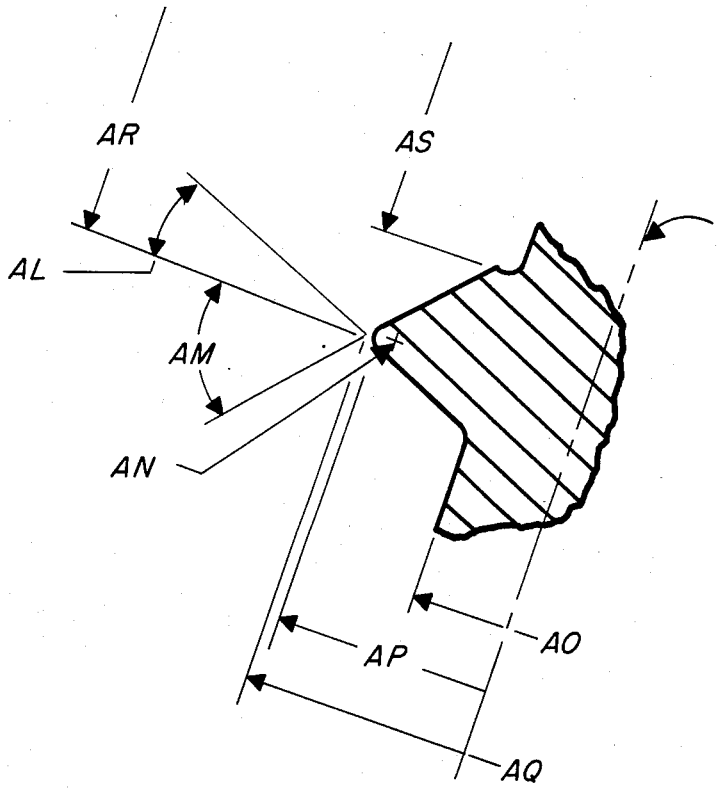
FIG. 7 is a sectional view F—F of FIG. 5.

The concept of this invention is applicable to any firearm where the ejection pattern may be rearward. However, the shape of the physical embodiment might require some change to adapt it to a particular firearm. In regards to the M16 Series Rifle, from painstaking experimentation it was discovered that certain features are critical. One critical feature is the 46° slant to surface 103 looking from the top down on the boss, as shown in FIG. 7 which is a detail of Section F—F. If less than 46°, then at very high cyclic rates of fire, the fired cartridge cases will strike surface 103 and spin back into the ejection port and cause a malfunction. Another critical feature is the distance surface 103 extends out from the center line of the receiver, which is along the 1.31" radius shown in FIG. 5.

While the invention may have been described with reference to a particular embodiment or embodiments, it should be understood that various substitutions and modifications thereto are possible, and that all such changes are also included in this disclosure of the invention, as will occur to one skilled in this art.

What is claimed is:

1. A receiver for a firearm wherein spent cartridge cases are ejected in a trajectory of motion rearwardly at a side ejection port thereof, said port having a back stop rib means at its rear position, said receiver ejecting cases whose rearward motion is stopped when striking said back stop rib means and also cases whose rearward motion is not stopped despite striking, or by completely missing of, said back stop rib means and continue in a rearward trajectory towards the person of the shooter, said receiver comprising a boss thereon to change the rearward trajectory of those non-stopped cases so they can never strike the physical body of the shooter, on account of their changed trajectory.

2. A receiver for a firearm wherein spent cartridge cases are ejected in a trajectory of motion rearwardly at a side ejection port thereof, said port having a back stop means at its rear position, said receiver ejecting cases whose rearward motion is stopped when striking said back stop means and also cases whose rearward motion is not stopped despite existence of said back stop means and continue in a rearward trajectory, said receiver comprising a boss thereon to change the rearward trajectory of those cases which are not stopped so those non-stopped cases which in their rearward motion reach as far back as the body position of a shooter of said firearm, cannot nonetheless strike the physical body of the shooter, on account of their changed trajectory.

3. A receiver as in claim 2 wherein said firearm is a rifle.

4: A receiver as in claim 3 wherein the changed trajectory is to be in a direction going above the head of the shooter.

* * * * *